United States Patent [19]

Nygren

[11] 4,338,805

[45] Jul. 13, 1982

[54] LOCK

[76] Inventor: Lennart Nygren, Smörblommevägen 2B, 73400 Hallstahammar, Sweden

[21] Appl. No.: 199,512

[22] PCT Filed: Oct. 15, 1979

[86] PCT No.: PCT/SE79/00208

§ 371 Date: Jun. 18, 1980

§ 102(e) Date: May 27, 1980

[87] PCT Pub. No.: WO80/00860

PCT Pub. Date: May 1, 1981

[30] Foreign Application Priority Data

Oct. 18, 1978 [SE] Sweden ..... 7810878

[51] Int. Cl.[3] ..... E05B 21/00; E05B 25/00

[52] U.S. Cl. ..... 70/134; 70/207; 70/352

[58] Field of Search ..... 70/134, 207, 352, 361, 70/350

[56] References Cited

U.S. PATENT DOCUMENTS 853,926 5/1907 Hope ..... 70/361
3,780,548 12/1973 Anastasov ..... 70/352
4,007,615 2/1977 Nossum ..... 70/387
4,149,394 4/1979 Sornes ..... 70/352

*Primary Examiner*—Robert L. Wolfe

[57] ABSTRACT

A lock including a lock casing (1), a locking mechanism (2) dislaceable therein and connected to a latch bolt (2*a*) and block means (12), which are movable transversally to the displacement direction of the locking mechanism and resiliently loaded (14) towards positions blocking the locking mechanism, wherein the blocking means can be brought to releasing positions by insertion of a card (3) serving as a key and having recesses (3*a*) corresponding to the blocking means. The blocking means (12) are preferably annular and entirely guided in the displaceable locking mechanism (2) as well as moveable between two blocking end positions, in which each blocking means is in locking engagement with the lock casing (1*a*,1*b*). The card (3) belonging to the lock has through-going, elongated slits (3*a*) located and dimensioned to receive the annular blocking means (12), so that upon insertion of the card all the blocking means (12) are brought to intermediate positions permitting the displacement of the locking mechanism.

9 Claims, 6 Drawing Figures

LOCK

The invention relates to a lock of the kind stated in the preamble of claim 1, i.e. a lock which is operable by means of a punched card serving as a key.

In a lock of this kind known from the Swedish patent specification No. 365 572, the blocking means are formed as pins and are actuated by control pins with pointed ends, which fit into corresponding recesses or blind holes in the key card.

To enable a large amount of combinations the key card must have a certain thickness, so that the blind holes can be made of different depths and, moreover, a bevel serving as a cam is needed to lift the control pins when the card is inserted. Therefore, the latter must be made of a hard and wear-resistant material, such as steel, and be produced with great precision.

The object of the invention is to achieve a lock of the above kind, such that the wear of the key card is reduced to a minimum when the same is inserted into the lock. Furthermore, the card should be made as thin as possible and, in spite thereof, it should permit a large number of locking combinations and preferably be made of plastic material.

As appears from claim 1, the lock according to the invention has the features that each blocking means comprises a substantially arcuate portion, whereas the card of the lock has through-going slits located and dimensioned to receive the arcuate portions of the blocking means. It is hereby achieved that upon inserting the punched card, the arcuate portions of the spring-loaded blocking means can easily slide or roll up onto the card, i.e. with negligible friction, and thereafter be pressed down by their springs into the corresponding, through-going slits of the card, so that all of the blocking means are brought into releasing positions. Of course, the blocking means should be mounted in such a way that they block even during the insertion of the card and, likewise, if a similar, but false key card or another object is inserted into the lock.

In a preferred embodiment, the blocking means are circular, in particular annular, and are guided by slits in mutually parallel plates being connected at some distance to each other and forming together a locking mechanism which is displaceable in a lock casing. When inserting the punched card transversally to the displacement direction of the locking mechanism and in parallel to the plane of the circular, annular blocking means, these blocking means will roll up onto the card and be resiliently pressed down into the slits of the punched card, whereby the blocking means take well-defined positions being free from locking tongues in the upper and lower parts of the lock casing. The springs of the blocking means, especially helical springs, are preferably guided within sleeves, which are arranged inside each circular ring and have recesses in their upper and lower parts so as to permit the rings to perform a rather large motion upwards and downwards.

The invention will be described further below the reference to the drawings, which illustrate a preferred embodiment of the lock according to the invention.

Figure 1:
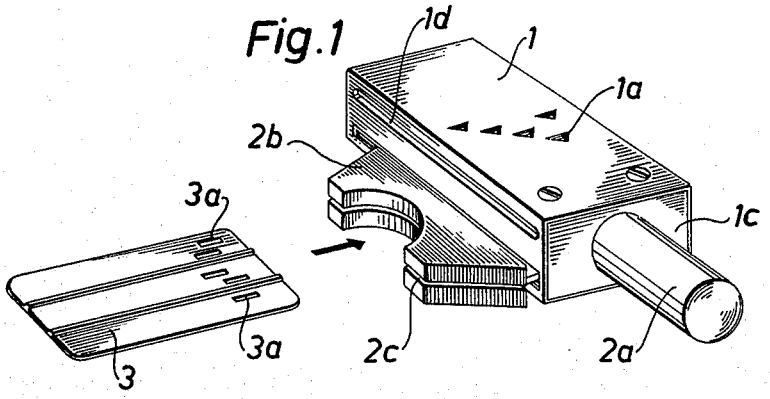
FIG. 1 is a perspective view of a lock according to the invention and a corresponding punched card key.

FIG. 1 illustrates the box-shaped casing 1 of the lock which is suitably made of metal sheet and comprises locking tongues, 1*a*,1*b* punched into the upper and lower parts thereof, said locking tongues co-operating with an internal locking mechanism 2. The latter is connected to a bolt 2*a* protruding through an opening in the front end 1*c* of the lock casing and to a lock grip 2*b* protruding transversally from one side of the lock casing, said grip having an insertion opening 2*c* for receiving a punched card 3 serving as a key.

Figure 2:
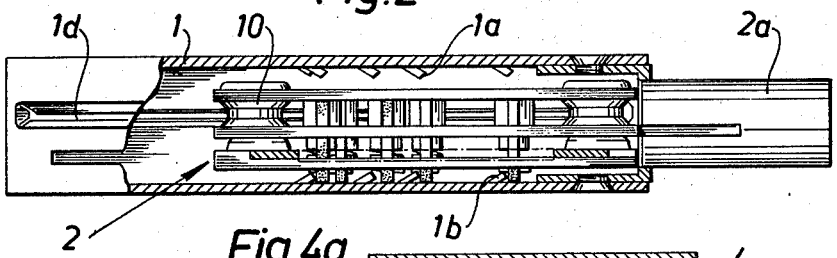
FIG. 2 is a side view of the lock, partly in axial section.

As appears from FIG. 2, the locking mechanism 2 is linearly displaceable in the lock casing 1 while being guided by opposite profile elements 1*d*, 1*e*, which are formed by bending the longer walls of the lock casing. Upon insertion of the card 3 into the insertion opening 2*c*, the lock grip 2*b* can be gripped by hand, and the locking mechanism 2 can be displaced at will in the lock casing, so that the bolt 2*a* performs a corresponding displacement movement.

Figure 3:
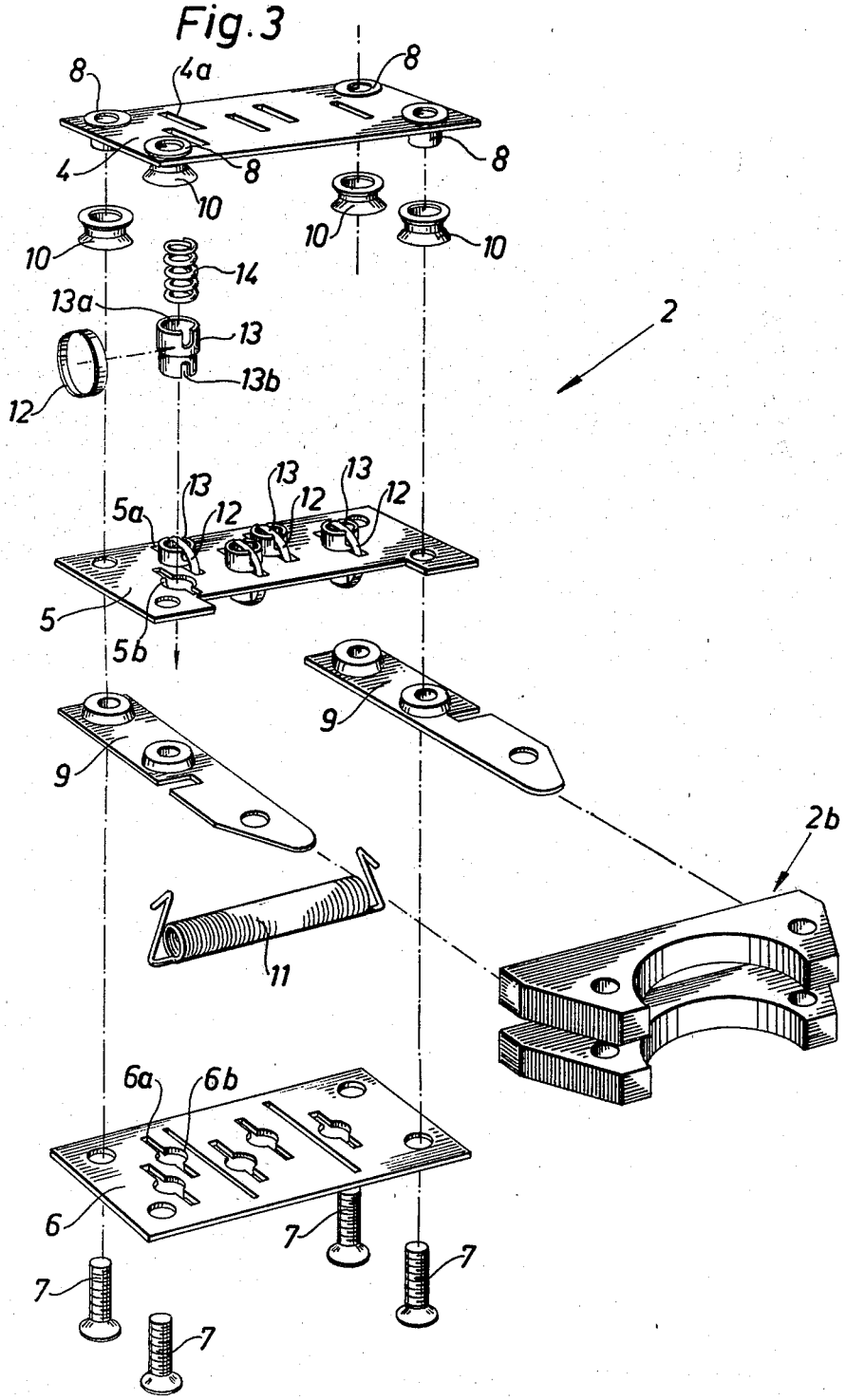
FIG. 3 is an exploded view of the different portions of a locking mechanism.

In FIG. 2 the locking mechanism 2 is shown in assembled condition. However, the different parts thereof appear more clearly from FIG. 3, where the parts are dismounted. Thus, the locking mechanism 2 comprises three parallel plates, namely an upper plate 4, a middle plate 5, and a lower plate 6. These three plates 4,5,6 are held together by means of four screws 7, though at a certain distance from each other by means of four distance sleeves 8 between the upper plate 4 and the middle plate 5 as well as two lock grip holders 9 between the middle plate 5 and the lower plate 6. The distance sleeves 8 are fastened to the upper side of the upper plate 4 and internally threaded to receive the screws 7. Around each distance sleeve 8 a roller 10 is rotatably mounted, and these rollers are in rolling engagement with the profile elements 1*d*, 1*e* of the lock casing so as to provide the above-mentioned guidance of the locking mechanism. The lock grip 2*b* is fastened to the lock grip holders 9 by means of fastening means (not shown), such as screws, and a curtain spring 11 is fastened to the middle plate 5 in such a way that it contacts the lower plate 6 and prevents observation into the lock.

The means arranged to block the displacement of the locking mechanism in the lock casing 1 consists of circular rings 12 each oriented in plane transverse to the displacement direction of the locking mechanism, and guided in throughgoing slits 4*a*,5*a*,6*a* located in registry to each other in the three plates 4,5,6. The length and width of these slits somewhat exceed the outer diameter and the axial width, respectively, of the rings 12 so as to permit the upward and downward movement of the rings. The slits 5*a*,6*a* in the middle plate 5 and the lower plate 6 have central, circularly widened portions 5*b*,6*b*, in which a guide sleeve 13 for a helical spring 14 is located inside each ring 12. Each helical spring 14 contacts the upper plate 4 (the turns of the helical spring having a larger diameter than the width of the slit 4*a*) and, at its lower end, the inside of the ring 12, so that each ring is spring loaded downwards towards the bottom plate of the lock casing 1, where the locking tongues 1*b* secure that the locking mechanism is fixed against any displacement. In order not to prevent the possibility of the ring 12 to move upwards and downwards, each guide sleeve 13 is provided with opposite recesses 13*a*, 13*b* in the upper and lower ends. Apart from the possibility of each ring 12 to move vertically, it has the possibility to rotate around its axis, which can be used when the punched card shown in FIG. 1 is inserted into the locking mechanism 2 so as to contact the rings 12 with its front edge. The guide sleeves 13 and the helical springs 14 are, however, kept stationary in their vertically oriented positions.

Figure 4A:
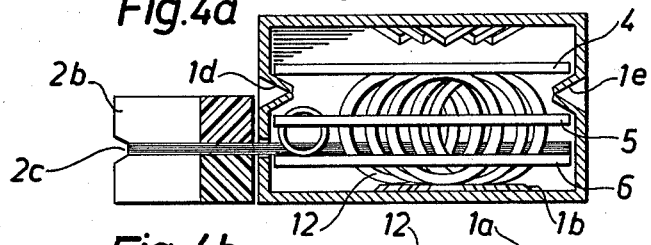
FIGS. 4*a–c* are cross-sectional views of the lock in a "lower locking position", an "upper locking position", and a "central releasing position", respectively.
Figure 4B:
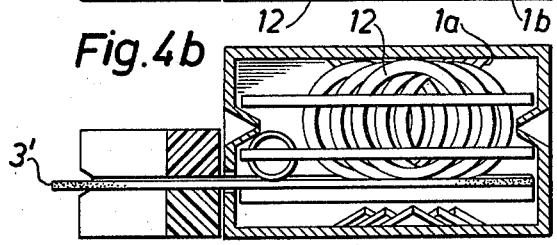
Figure 4C:
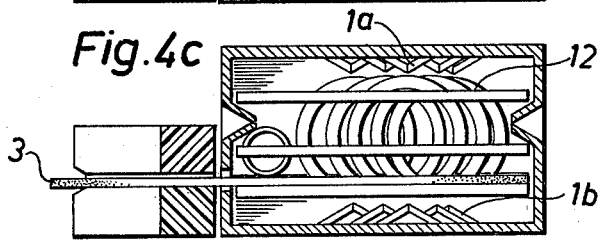

When the lock is empty, i.e. before any punched card 3 has been inserted, the rings 12 are—as mentioned above—pressed down against the bottom of the lock casing and engage with the locking tongues 1*b*. This condition constitutes the "lower locking position" and is schematically shown in FIG. 2 and FIG. 4*a*. In FIG. 4*b* the "upper locking position" of the lock is shown, wherein a card not adapted to the lock, or any other flat object 3', has been inserted into the opening 2*c* of the lock grip 2*b* between the middle plate 5 and the lower plate 6 (and sideways between the lock grip holders 9). The rings roll up onto the card or the object 3' (against the action of the springs 13) and are thus instead pressed upwards against the underside of the upper wall of the lock casing, where they get into locking engagement with the upper locking tongues 1*a*. Because the rings 12 are mutually displaced in the inserting direction, the locking mechanism 2 is kept fixed even during the insertion operation itself, since the rings located nearest to the opening 2*c* will lock at the upper position before the rings furthest away release their locking engagement in the lower position. The lock can only be opened by a punched card 3 adapted thereto and having through-going slits 3*a*, which are located in correspondence to the slits 4*a*,5*a*,6*a* in the plates 4,5,6 of the locking mechanism. However, the slits 3*a* are somewhat shorter than the slits 4*a*,5*a*,6*a*, so that by the action of the springs 13 the rings 12 are pressed down only partly into the respective slits 3*a*, i.e. preferably so far that the rings 12 have appr. $\frac{2}{3}$ of their diameter located above the lower plate 6 when touching both ends of the slit. Thus, upon insertion of the "right" card 3, the rings will firstly roll up onto the upper side of the card (and lock in the upper position as shown in FIG. 4*b*) and, when the card has been inserted into its final position with the slits 3*a* in registry with the slits 4*a*,5*a*,6*a*, the rings roll down partly into the respective slit 3*a*, and reach intermediate, hanging positions, as shown in FIG. 4*c*, i.e. free from engagement with the upper as well as the lower locking tongues 1*a* and 1*b*, respectively. In this "releasing position" the entire locking mechanism 2 including the latch bolt 2*a* can be displaced by hand in either direction along the side guides 1*d*, 1*e* of the lock casing.

In the illustrated embodiment, the lock is primarily intended to be used in such doors, shutters, or the like, wherein the lock only needs to be operated from one side. By means of a symmetric arrangement of the blocking means 12 and a symmetric shape of the lock casing 1 and the locking mechanism 2, the lock can easily be adjusted to be operated from both sides.

By varying the number of the rings 12 and their relative distribution in two dimensions, as may be desired, a very large number of combinations can be obtained. In principle (though impractical from the manufacturing and assembling points of view), the rings 12 may have somewhat different diameters and the slits 3*a* in the punched card 3 may be of correspondingly different lengths, whereby the number of combinations could be increased even more. Also, the fact that the insertion opening 2*c* needs to be only slightly wider than the thickness of the card 3, e.g. appr. 1.5 mm, contributes to the security of the lock, and moreover the curtain spring 11 protects the lock from observation through the narrow opening.

Another advantage of the lock according to the invention is that the lock casing 1 and the parts 4,5,6,9 of the locking mechanism 2 can be made easily by pressing, bending and punching of relatively thin metal sheets, whereas e.g. the lock grip 2*b*, the guide sleeves 13 and the card itself can preferably be made of plastic material.

What is claimed is:

1. A lock including a lock casing, a locking mechanism displaceable in said lock casing and connected to a latch bolt, and annular blocking means, which are movable transversally to the displacement direction of the locking mechanism and resiliently loaded towards positions blocking the locking mechanism, the blocking means being adapted be brought to releasing positions by insertion of a card serving as a key and having recesses corresponding to the blocking means, said blocking means being entirely guided in the displaceable locking mechanism and movable between two blocking end positions, in which each blocking means is in locking engagement with the lock casing, and said card belonging to the lock having through-going, elongated slits located and dimensioned to receive arcuate portions of the blocking means, so that upon insertion of the card all the blocking means are brought to intermediate positions permitting the displacement of the locking mechanism.

2. A lock according to claim 1, wherein the blocking means are circular.

3. A lock according to claim 1, wherein the annular blocking means are guided in slits in parallel, mutually connected plates.

4. A lock according to claim 3, wherein inside each annular blocking means a sleeve is disposed to form a guiding means for a helical spring acting on the blocking means.

5. A lock according to claim 3 or 4, wherein said locking mechanism substantially consists of three plates connected at a distance in parallel to each other, and wherein said card is insertable between two of these plates.

6. A lock according to claim 1, wherein said blocking means are undivided.

7. A lock according to claim 1, wherein said blocking means are identical with respect to each other.

8. A lock according to claim 1, wherein the relative positions of the slits of the card in the plane thereof are specific to the lock and correspond to the distribution of the locking means in the locking mechanism.

9. A lock according to claim 1, wherein said intermediate positions are each located at the same distance from the respective blocking end positions.

* * * * *